US007837051B2

(12) United States Patent
Broadhead et al.

(10) Patent No.: US 7,837,051 B2
(45) Date of Patent: Nov. 23, 2010

(54) METHOD OF LOCKING A CONTAINER FOR PRERECORDED STORAGE MEDIA

(75) Inventors: Robert Malcolm Broadhead, Grants Pass, OR (US); David Frank Whitehead, Romford (GB)

(73) Assignee: Checkpoint Systems, Inc., Philadelphia, PA (US)

( * ) Notice: Subject to any disclaimer, the term of this patent is extended or adjusted under 35 U.S.C. 154(b) by 88 days.

(21) Appl. No.: 11/085,716

(22) Filed: Mar. 21, 2005

(65) Prior Publication Data

US 2005/0184530 A1 Aug. 25, 2005

(51) Int. Cl.

| | |
|---|---|
| ***B65D 51/00*** | (2006.01) |
| ***E05C 19/10*** | (2006.01) |
| ***E05B 65/00*** | (2006.01) |
| *B65D 85/575* | (2006.01) |

(52) U.S. Cl. ..... 220/230; 220/4.22; 220/843; 220/844; 220/836; 206/387.11; 292/116; 292/302; 292/87; 70/57.1

(58) Field of Classification Search ..... 220/4.22, 220/210, 833, 836, 843, 844, 230; 206/387.11, 206/1.5, 308.2; 70/57.1, 63; 292/302, 116, 292/129, 251.5

See application file for complete search history.

(56) References Cited

U.S. PATENT DOCUMENTS

| | | | | |
|---|---|---|---|---|
| 2,866,574 A * | 12/1958 | Roumeliotis | ..... | 220/326 |
| 5,193,707 A * | 3/1993 | Mizumura | ..... | 220/326 |
| 5,598,728 A * | 2/1997 | Lax | ..... | 70/276 |
| 5,760,689 A * | 6/1998 | Holmgren | ..... | 340/568.8 |
| 5,762,187 A * | 6/1998 | Belden et al. | ..... | 206/387.11 |
| 5,782,350 A * | 7/1998 | Weisburn et al. | ..... | 206/308.2 |
| 6,059,135 A | 5/2000 | James et al. | | |
| 6,367,639 B1 * | 4/2002 | Mar | ..... | 215/213 |
| 6,430,976 B1 * | 8/2002 | Mitsuyama | ..... | 70/57.1 |

* cited by examiner

*Primary Examiner*—Robin Hylton
(74) *Attorney, Agent, or Firm*—Sand & Sebolt

(57) ABSTRACT

A method of locking a container is shown, wherein the container is provided with a frame which has an access opening, a closure member which has two opposed long edges and two opposed short edges, and which is pivotally mounted in relation to the frame, and a latch member which is axially movable within the closure member between a latched position and an unlatched position. The latch member and the frame are each provided with one or more interengageable detents whereby when the closure member is in a closed position and the latch member is in the latched position the detents are engaged and prevent pivoting of the closure member. Movement of the latch member to the unlatched position causes the detents to disengage and permit pivoting of the closure member. The closure member is provided with a locking member for engaging the latch member to retain it against axial movement. A magnetic release device, such as a magnet, is capable of externally manipulating the locking member between the locked position and the unlocked position.

11 Claims, 7 Drawing Sheets

METHOD OF LOCKING A CONTAINER FOR PRERECORDED STORAGE MEDIA

CROSS REFERENCE TO RELATED APPLICATION

Benefit is hereby claimed of the filing date under 35 U.S.C. §§119 and/or 120, and 37 CFR §1.78 to U.S. application Ser. No. 09/958,432, filed on May 7, 2002, and entitled "Lockable Container for Prerecorded Storage Media, now U.S. Pat. No. 6,926,164.

FIELD OF THE INVENTION

The present invention relates to a lockable container, notably a lockable container for displaying pre-recorded storage media such as digital versatile discs (DVDs), video cassettes or compact discs (CDs).

BACKGROUND TO THE INVENTION

Pre-recorded storage media such as CDs and video cassettes are usually put up for sale in a plastic case or the like, which carries information about the disc or tape as well as carrying sales promotional material or artwork to attract a purchaser. To prevent theft of the media from a shop various lockable display containers have been proposed which house the disc or tape in its case and prevent a thief gaining access to the disc or tape without breaking the container or removing the container from the shop. The container can be fitted with alarm means so that it cannot be removed from the shop without actuating an alarm. One type of known container employs a spring loaded pin or the like which locates in a recess in a wall of the case, for example as disclosed in EP 0 312 172. Such containers can only be used with cases of a specific size, which have a recess which registers with the pin. Other types of container employ a spring loaded pin to retain a stop member over part of an access opening in the container, displacement of the pin by a magnet permitting the stop member to move out of the way of the access opening by translation or by translation and pivoting, for example as disclosed in EP 0 541 733 and EP 0 666 954.

Most lockable display containers have an access opening which is at least partly open at all times, to permit insertion and removal of the disc or tape in its case. A problem with such containers is that the disc or tape is only protected from damage at the opening by its case, which therefore needs to be tough. For cost reasons, however, it is desirable to make cases from more frangible materials such as cardboard or vacuum-formed plastics materials. Many DVDs, for example, are sold in soft, vacuum-formed plastics cases.

It has been proposed, in WO95/14841, to provide an anti-theft box comprising a cassette with an elongate opening at one face. The cassette has a lid which can be locked to cover the open end of the cassette. To lock the lid on the cassette, a lock mechanism is provided which comprises a lock slide which has lock bolts for engaging in holes in the lid and in a long side wall of the cassette. The lock slide is moved transversely to the long axis of the opening to lock and unlock the lid. The lock slide is moved by an operating slide which slides transversely to the movement of the lock slide, or by an operating pin which is passed from the lower side of the lock slide through a transverse slot in the lock slide and attached to the lock slide.

The present invention seeks to provide an improved lockable container for DVDs and other valuable items.

SUMMARY OF THE INVENTION

According to an aspect of the present invention there is provided a lockable container for an article, comprising a frame which has an access opening whereby an article can be inserted into or removed from the frame, and a closure member which is pivotally mounted in relation to the frame and pivotable between an open position in which an article can be inserted into or removed from the frame through the access opening and a closed position in which the closure member blocks substantially all of the access opening, the closure member housing an elongate latch member which is axially movable within the closure member between a latched position and an unlatched position, the latch member and the frame each being provided with one or more interengageable detents whereby when the closure member is in the closed position and the latch member is in the latched position the detents are engaged and prevent pivoting of the closure member, movement of the latch member to the unlatched position causing the detents to disengage and permit pivoting of the closure member, the closure member being provided with a locking member adapted to move between a locked position at which the locking member engages the latch member so as to retain it against axial movement, and an unlocked position at which the locking member permits axial movement of the latch member.

The latch member may be of unitary construction for simplicity of manufacture. It may be moved to the latched position by pushing with a user's finger.

The frame could be a skeletal frame, but it is preferred that the frame has no openings other than the access opening, so that when the closure member is in the closed position an article contained within the frame cannot be tampered with.

The container of the invention is of particular use for storing and displaying DVDs and other media which are fragile or which have frangible or scratchable cases.

The frame preferably comprises two rectangular or square flat sides and four narrow sides, one of which provides the access opening.

The entire locking mechanism may be housed in the closure member, which may have external features to enable the container to be mounted in a display rack. This permits a plurality of containers to be stacked side by side without any part of the locking mechanism projecting sideways or upwards. Alternatively, the closure member could be provided with hanging means, for example a hook, to permit the container to be hung up without projections from the bottom or sides of the container taking up space.

The locking member can be a spring biased jaw or clamp which acts to grip the latch member. However it is preferred that the locking member positively engages with the latch member, for example by engaging in a slot or recess so that the latch member is positively secured in position once it reaches the latched position. A leaf spring or a spring-biased magnetic pin may be used. In a preferred embodiment, the locking member is a pin which is spring biased in a bore or recess in a basal wall of the closure member. The exposed head of the pin may locate in a hole in the latch member in a similar manner to the engagement of the pin and sliding rail in EP 0 541 733. The pin may be withdrawn from the latch member by means of a magnet, to permit the latch member to be slid to the unlatched position.

In a preferred embodiment, the latch member is biased to either the latched or the unlatched position by spring means. To facilitate opening of the container, it is preferred that the latch member is biased to the unlatched position, so that when the locking member is moved to the unlocked position the latch member moves to the unlatched position.

When in the latched position, the latch member preferably prevents pivoting of the closure member to the open position by engagement of at least one of the detents with at least one tab on the closure member. This permits the container to be assembled by simply placing the latch member in the closure member. However, the invention is not limited to this embodiment, and other means could be used for preventing pivoting. For example, the closure member may be provided with a pocket or groove in which the latch member is slidably received.

BRIEF DESCRIPTION OF THE DRAWINGS

The invention will now be further described, by way of example, with reference to the following drawing in which.

DETAILED DESCRIPTION

The display container comprises a tough, transparent frame 2, for example of polycarbonate, a closure member 10 and a latch member 28.

Figure 1:
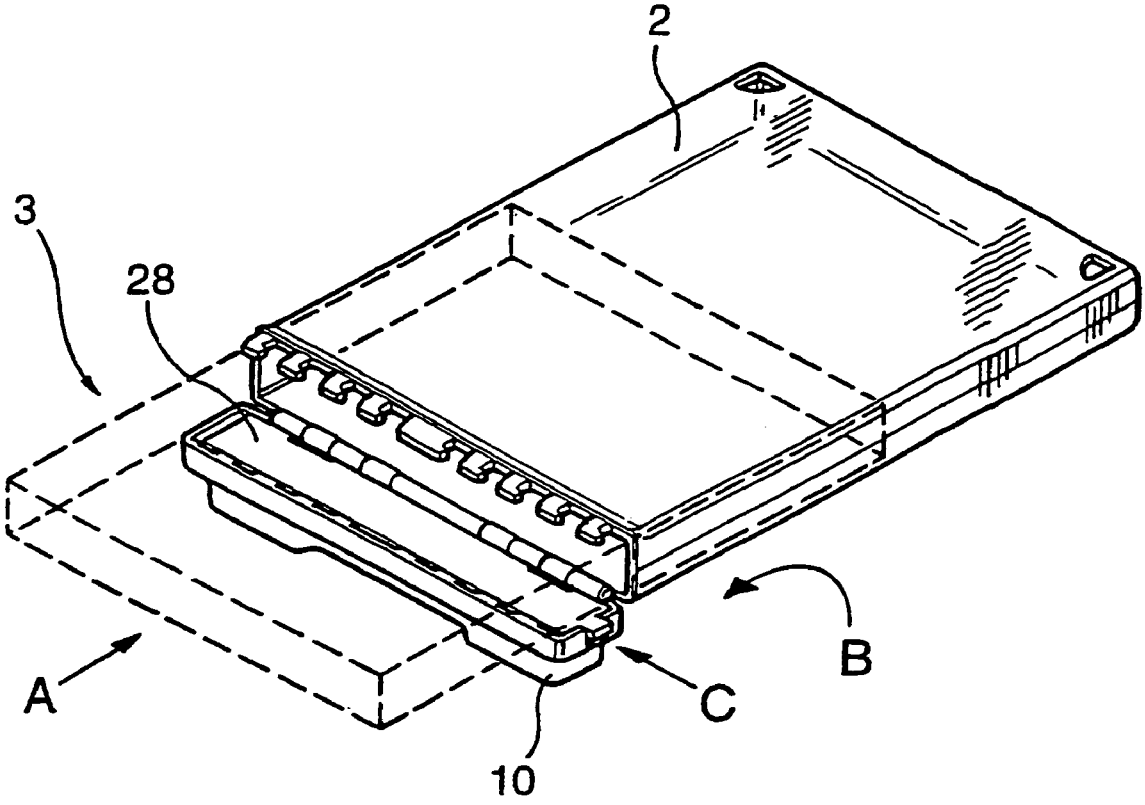
FIG. 1 is a perspective view of a lockable container for display of a DVD case in accordance with one aspect of the present invention.
Figure 2:
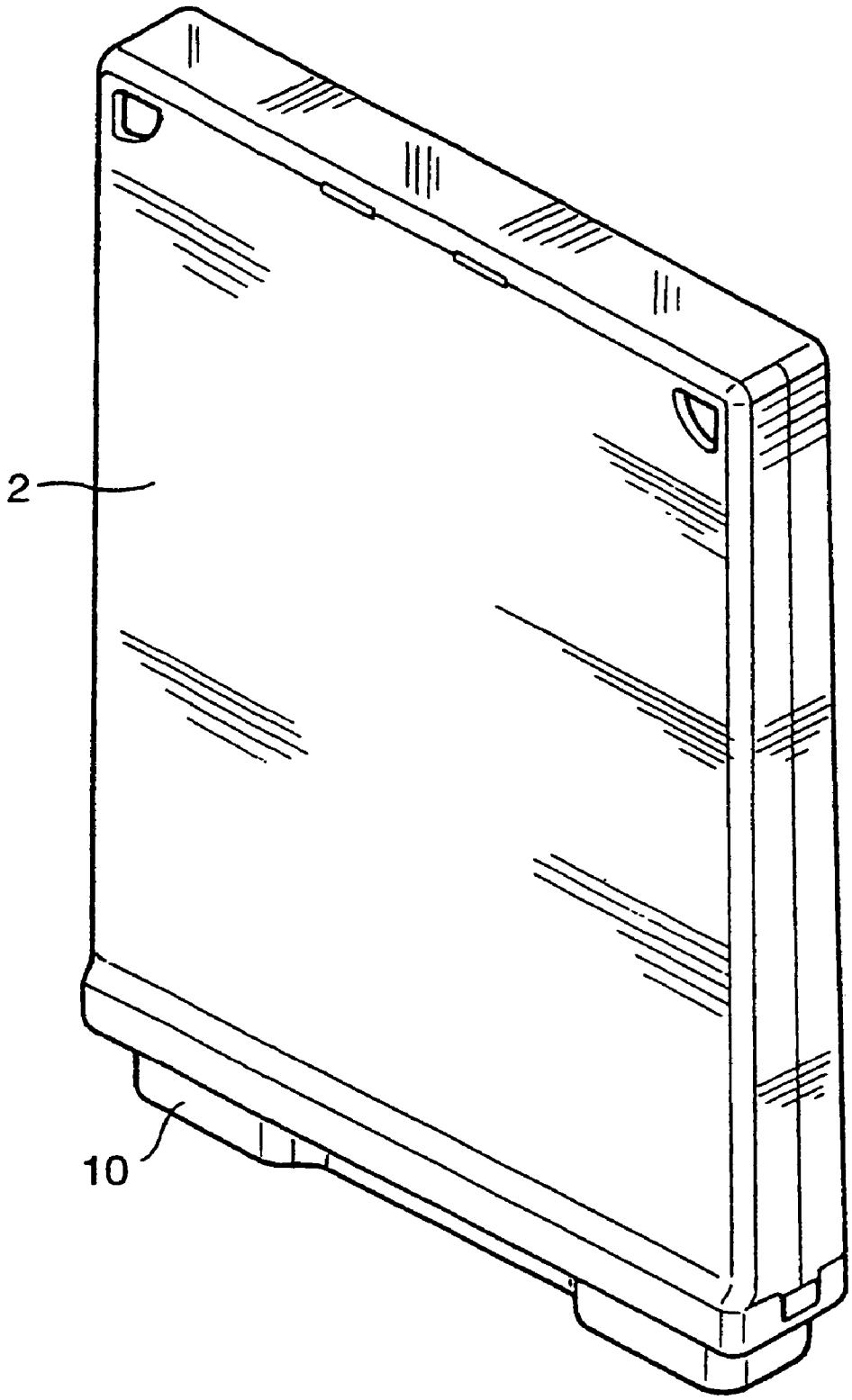
FIG. 2 is a perspective view of the lockable container of FIG. 1 in a locked state.
Figure 3:
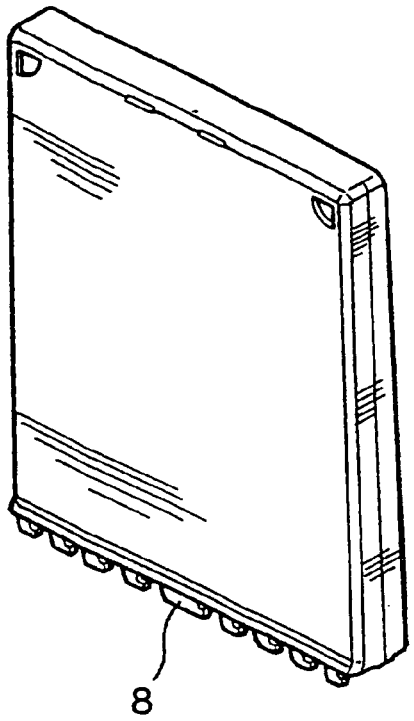
FIGS. 3 and 4 are perspective views of the frame of the lockable container of FIG. 1.

The frame 2 is in this example a generally parallelepipedic box having an elongate access opening 4 along one face. For manufacturing convenience, the frame 2 has two small wedge-shaped apertures at the bottom corners of one face. These apertures are not important or necessary for the functioning of the container, and could be eliminated so that the frame 2 has only a single opening. The frame 2 is dimensioned so that a case 3 for a DVD, shown in broken lines in FIG. 1, is a sliding fit within the container.

To lock the DVD case 3 in the container, the case 3 is fully inserted into the frame 2 in the direction of the arrow A. The frame is then pivoted about a hinge in the direction of the arrow B so that its access opening 4 is covered by the closure member 10. Finally, the elongate latch member 28 is pushed axially in the direction of arrow C to lock the closure member 10 to the frame 2 as will be explained below.

Figure 4:
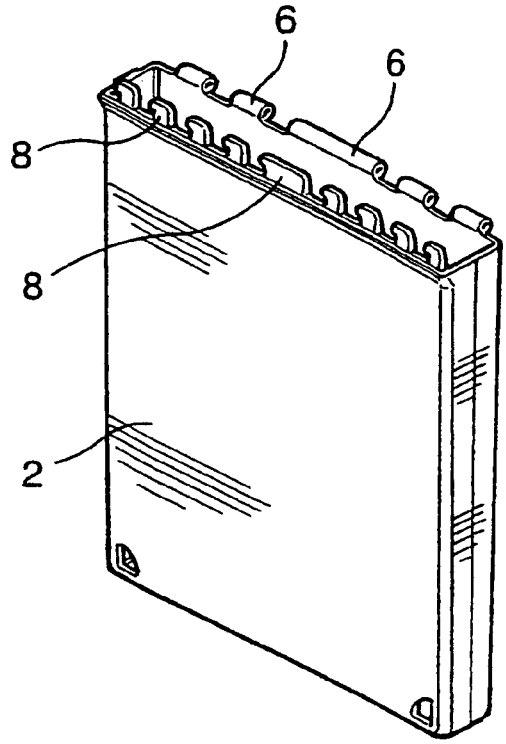
Figure 5:
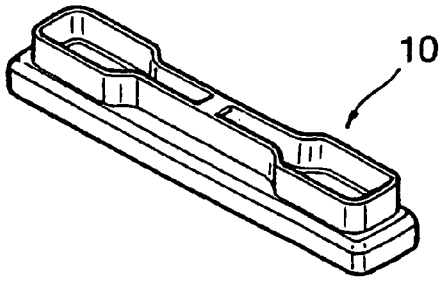
FIGS. 5 and 6 are perspective views of the closure member of the lockable container of FIG. 1.
Figure 7:
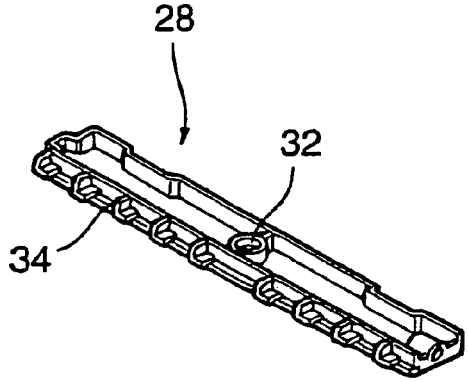
FIGS. 7 and 8 are perspective views of the latch member of the container of FIG. 1.
Figure 6:
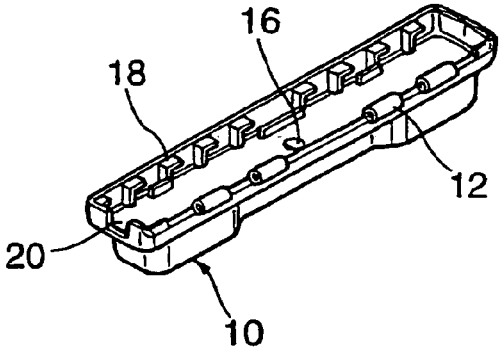
Figure 8:
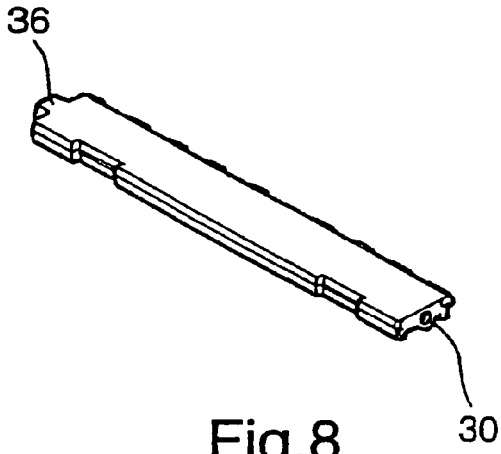
Figure 9:
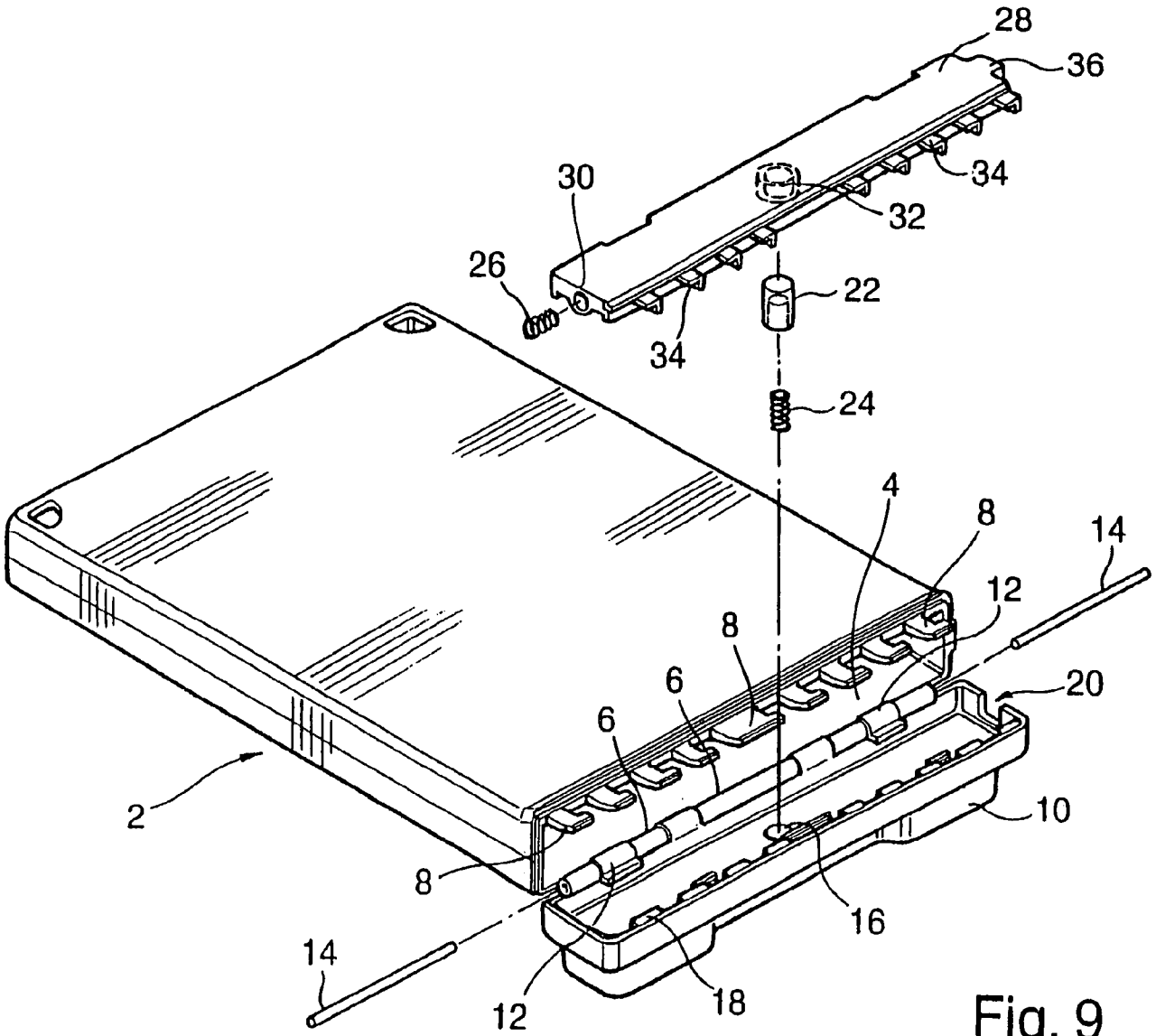
FIG. 9 is an exploded view of the lockable container of FIG. 1.

The frame 2 has hinge members 6 along one long edge of the access opening 4, and a plurality of generally L-shaped detent members 8 formed along the opposed edge, as best shown in FIG. 4. The closure member 10 has hinge members 12 along one long edge, as best shown in FIG. 6. The respective hinge members 6, 12 butt together side by side to form a pair of hinge housings having blind tubular bores into each of which is inserted a hinge pin 14. The hinge pin 14 is a close fit for the insides of the hinge members 6, 12 and, once inserted, cannot be removed without breaking the container.

Figures 10, 11, 12:
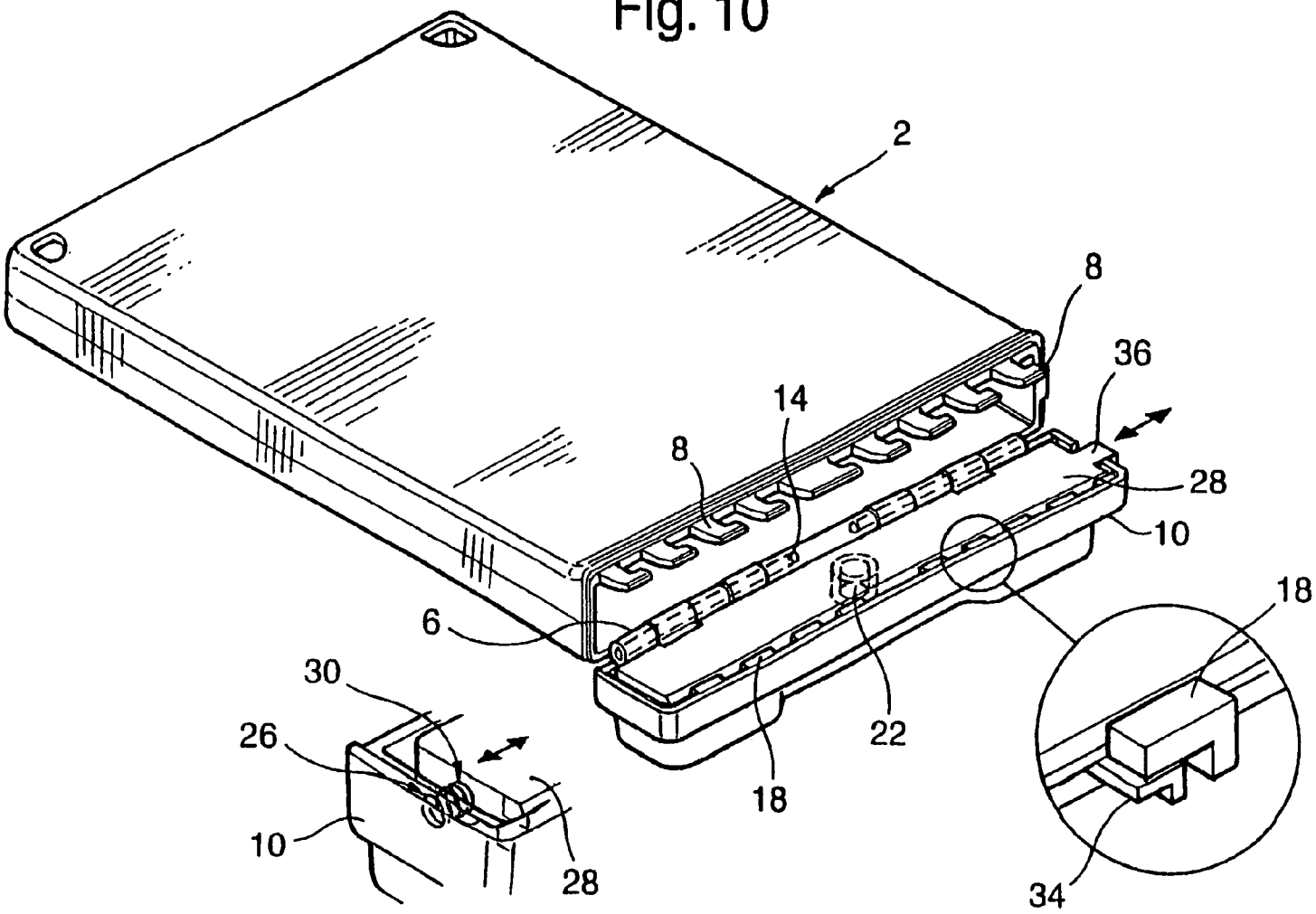
FIG. 10 is a perspective view of the container of FIG. 9 when assembled, with the closure member in an open position.
FIGS. 11 and 12 are enlarged partial X-ray views of details of the container of FIG. 10.

The latch member 28 is slidably housed in the closure member 10, retained by tabs 18 on the closure member 10. At one end of the latch member 28 is a blind bore 30 for receiving a spring 26. When the latch member 28 is housed in the closure member 10, the spring 26 biases the latch member to the right as shown in FIG. 10.

The closure member 10 has a blind bore 16 and the latch member 28 has a blind bore 32. A magnetically movable pin 22 sits in the bore 16 on the closure member, biased towards the latch member 28 by a spring 24. If the latch member is pushed to the left as shown in FIG. 10, for example by the action of a user's finger on a nub 36 which projects through an aperture 20 in the closure member, the bores 16, 32 move into register and the pin 22 is urged transversely to locate in the bore 32 in the latch member thereby preventing axial movement of the latch member. It can thus be seen from FIGS. 1 and 10 that the latch member 28 moves in a common plane with the closure member 10 and along an axis parallel with the long edges of the closure member movement of the latch member 28 in the said axial direction allowing the spring biased magnetic pin 22 to move from the unlocked position to a locked position engaging the latch member 28.

To protect an article in the frame 2, the closure member 10 is pivoted about the hinge members 6, 12, with the latch member 28 in the unlatched position so that the closure member 10 completely blocks the access opening 4. In this closed position, the tabs 18 on the closure member and the detents 34 on the latch member are disposed in spaces adjacent to the detents 8 on the frame 2. The user pushes the nub 36 until the pin 22 engages in the latch member 28 as described above, thereby locking the latch member and preventing sliding movement of the latch member. In this position, the detents 34 on the latch member 28 engage with the detents 8 on the frame 2, thereby preventing pivoting of the closure member 10 away from the closed position.

Figure 13:
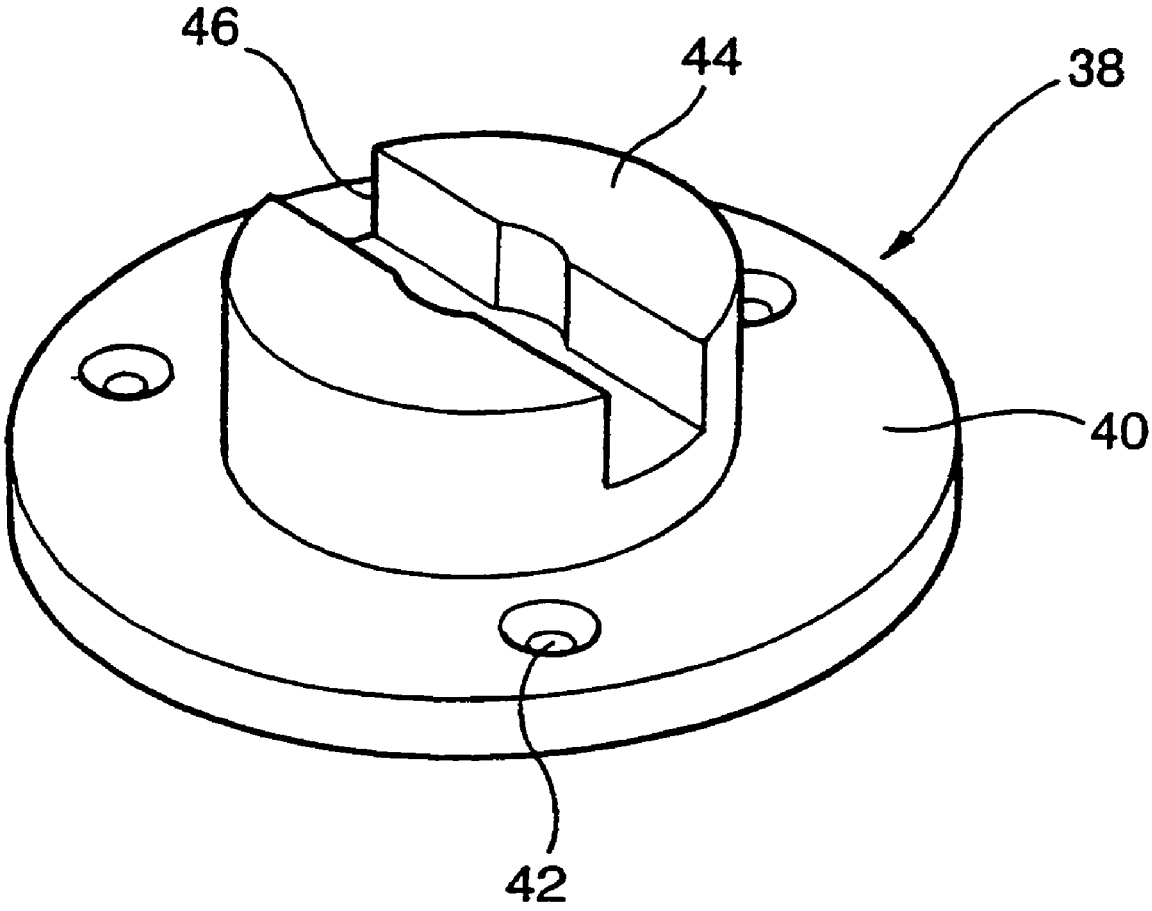
FIG. 13 shows a known magnetic device for releasing the locking member in a container in accordance with the present invention.

To open the container, a known magnetic release device 38 (FIG. 13) is used by the sales person. The magnetic release device 38 comprises a base plate 40 having screw holes 42 by which it is secured to a work surface (not shown). The base plate 40 carries a circular magnet 44 having a transverse diametric groove 46 cut in it. When the closure member 10 is inserted into the groove 46 the magnet 44 pulls the locking pin 22 to cause the pin 22 to withdraw fully from the bore 32 in the latch member 28. The spring 26 pushes the latch member 28 to the unlatched position, allowing the container to be opened by pivoting of the closure member to the open position.

The external face of the closure member 10 may be shaped to enable the container to stand up in a rack, or to be hung on a hook.

The invention provides a lockable container for protecting and displaying an article at point of sale, for example a DVD or a video cassette, optionally with packaging material to brace the product inside the container.

All the components of the container, except for the pin 22 and springs 24, 26 can be fabricated from injection moulded plastics materials which may be transparent or translucent. It is also envisaged that, as known per se, the interior of the container would be provided with a magnetic strip or the like which activates an alarm system if the container is removed without proper authorisation.

We claim:

1. A method of locking and unlocking a container for an article, the method comprising the steps of:

providing a frame which has two opposed long edges and two opposed short edges, the frame also having an access opening whereby an article can be inserted into or removed from the frame;

providing a closure member which is pivotally mounted in relation to the frame and pivotable between an open position in which an article can be inserted into or removed from the frame through the access opening and a closed position in which the closure member blocks substantially all of the access opening, the closure member also having two opposed long edges and two opposed short edges;

mounting an elongate latch member on the closure member which is axially movable within the closure member between a latched position and an unlatched position in a common plane with the closure member and along an axis parallel with the long edges of the closure member;

providing the latch member with at least one mating detent and the frame with at least one mating detent member on one of the long edges;

whereby, when the closure member is in the closed position and the latch member is in the latched position, the detent on the latch member will engage with the detent on the frame to thereby prevent pivoting of the closure member, and whereby movement of the latch member to the unlatched position will cause the latch member detents to move along an axis parallel with the long edges of the closure member to disengage the latch member detents and the frame detents and permit pivoting of the closure member;

the closure member also being provided with a locking member in the form of a spring-biased magnetic pin adapted to move between a locked position at which the locking member engages the latch member so as to retain it against axial movement, and an unlocked position at which the locking member permits axial movement of the latch member;

providing a magnetic release device that is capable of externally manipulating the spring-biased magnetic pin between the locked position and the unlocked position;

locking the container by moving the latch member in an axial direction within the closure member between the unlatched and latched positions, the latch member moving in a common plane with the closure member and along an axis parallel with the long edges of the closure member, movement of the latch member in the said axial direction allowing the spring biased magnetic pin to move from the unlocked position to a locked position engaging the latch member; and unlocking the container by using the magnetic release device to manipulate the spring-biased magnetic pin.

2. The method of claim 1 wherein the closure member is provided with a tab which is engaged by the detent on the latch member when the latch member is in the latched position so as to prevent pivoting of the closure member to the open position; and wherein the step of locking the container includes the step of engaging the tab on the closure member with the detent on the latch member.

3. The method of claim 1 wherein a spring is mounted within a bore provided in the latch member and extends outwardly therefrom to contact the closure member, wherein the latch member is urged to the unlatched position by the spring, the latch member being urged in an opposite direction during the step of locking the container.

4. The method of claim 1 wherein the latch member is provided with a region which is accessible to a user's finger and wherein the step of locking the container includes the step of pushing on that region when the latch member is in the unlatched position thereby causing the latch member to move axially to the latched position.

5. The method of claim 1 wherein the magnetic release device is a magnet that is capable of externally manipulating the locking member from the locked position to the unlocked position, thereby permitting axial movement of the latch member, and wherein the step of unlocking the container includes the step of a user externally manipulating the locking member with the magnet to move the locking member from the locked position to the unlocked position.

6. The method of claim 1 wherein the latch member detent and the frame detent are substantially similar in shape.

7. The method of claim 1 wherein the latch member detent is L-shaped.

8. The method of claim 1 wherein the frame detent is L-shaped.

9. The method of claim 1 wherein the latch member detent is formed having at least 6 distinct surfaces.

10. The method of claim 1 wherein the frame detent is formed having at least 6 distinct surfaces.

11. The method of claim 1 wherein the step of locking the container includes moving the latch member in a direction parallel with the at least one mating detent.

* * * * *

UNITED STATES PATENT AND TRADEMARK OFFICE

CERTIFICATE OF CORRECTION

PATENT NO. : 7,837,051 B2
APPLICATION NO. : 11/085716
DATED : November 23, 2010
INVENTOR(S) : Broadhead et al.

It is certified that error appears in the above-identified patent and that said Letters Patent is hereby corrected as shown below:

On the Title Page, left hand column between paragraphs (65) and (51), please insert the following:

-- Related U.S. Application Data

(63) Division of Application No. 09/958,432 filed on May 7, 2002, now Patent No. 6,926,164.

(22) PCT filed: April 10, 2000

(86) PCT No. PCT/GB00/01302
§ 371 (c) (1),
(2), (4) Date: May 7, 2002

(87) PCT Pub. No. WO00/61899

PCT Pub. Date: October 19, 2000

(30) Foreign Application Priority Data
April 9, 1999 (GB) 9908080 --

Col. 1, Lines 4-11 are replaced with -- RELATED APPLICATION DATA

This application is a divisional application of and claims priority to and benefit of US Application No. 09/958,432, now US Patent No. 6,926,164, filed on May 7, 2002, and entitled "Lockable Container for Prerecorded Storage Media". --

Signed and Sealed this
Eighth Day of November, 2011

David J. Kappos

David J. Kappos
*Director of the United States Patent and Trademark Office*